US006904961B2

(12) United States Patent
Ayres

(10) Patent No.: US 6,904,961 B2
(45) Date of Patent: Jun. 14, 2005

(54) PRIME SURFACE GAS COOLER FOR HIGH TEMPERATURE AND METHOD FOR MANUFACTURE

(75) Inventor: Steven Ayres, Redondo Beach, CA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/338,265

(22) Filed: Jan. 7, 2003

(65) Prior Publication Data

US 2004/0129411 A1 Jul. 8, 2004

(51) Int. Cl.[7] ..... F28F 3/10
(52) U.S. Cl. ..... 165/133; 165/166; 228/183
(58) Field of Search ..... 228/183; 165/157, 165/166, 133

(56) References Cited

U.S. PATENT DOCUMENTS

| | | | | | |
|---|---|---|---|---|---|
| 4,688,631 | A | * | 8/1987 | Peze et al. | 165/166 |
| 4,727,001 | A | * | 2/1988 | Takemoto et al. | 428/654 |
| 5,107,922 | A | | 4/1992 | So | |
| 5,314,570 | A | | 5/1994 | Ikegaya et al. | |
| 5,343,936 | A | * | 9/1994 | Beatenbough et al. | 165/41 |
| 5,462,113 | A | * | 10/1995 | Wand | 165/167 |
| 5,494,100 | A | * | 2/1996 | Peze | 165/157 |
| 5,555,933 | A | * | 9/1996 | Darragh et al. | 165/166 |
| 6,182,487 | B1 | | 2/2001 | Komiya et al. | |
| 6,192,978 | B1 | | 2/2001 | Guzowski et al. | |
| 6,244,333 | B1 | * | 6/2001 | Bergh et al. | 165/165 |
| 6,298,910 | B1 | * | 10/2001 | Komoda et al. | 165/133 |
| 6,446,712 | B1 | * | 9/2002 | Wu et al. | 165/167 |
| 6,595,271 | B2 | * | 7/2003 | Komoda | 165/133 |
| 2001/0015085 | A1 | | 8/2001 | Rhodes et al. | |
| 2001/0047861 | A1 | * | 12/2001 | Maeda et al. | 165/167 |
| 2002/0069998 | A1 | | 6/2002 | Cui et al. | |
| 2002/0074105 | A1 | | 6/2002 | Hayashi et al. | |
| 2002/0189255 | A1 | * | 12/2002 | Callas et al. | 60/605.1 |

FOREIGN PATENT DOCUMENTS

| | | | | |
|---|---|---|---|---|
| JP | 361165271 | A | 7/1986 | |
| JP | 407015814 | A | 1/1995 | |
| JP | 409171094 | A | 6/1997 | |
| JP | 2000135590 | A * | 5/2000 | B23K/35/22 |

* cited by examiner

*Primary Examiner*—Allen J. Flanigan
(74) *Attorney, Agent, or Firm*—Chris James; Ephraim Starr

(57) ABSTRACT

A high temperature prime surface heat exchanger is created using adjacent pairs of plates having braze cladding on a first surface thereof that are formed to create fluid flow passages for coolant and fluid flow passages for hot gas when assembled into a core by stacking the plates. The coolant passages are adjacent the first or clad surface of each formed plate to avoid direct contact with the high temperature gas flowing in the hot gas passages. The adjacent plate pairs are joined by brazing of a contacting portion of the first surface on each plate to form sealed coolant passages the core.

8 Claims, 3 Drawing Sheets

PRIME SURFACE GAS COOLER FOR HIGH TEMPERATURE AND METHOD FOR MANUFACTURE

BACKGROUND OF THE INVENTION

1. Field of the Invention

This invention relates generally to the field of prime surface heat exchangers for high temperature gases and, more particularly, to stainless steel plating for construction of a prime surface heat exchanger with a braze cladding on only one surface of the plate exposed to the coolant.

2. Description of the Related Art

A common method of manufacture for heat exchangers involves brazing. In manufacturing high temperature heat exchangers, such as gas coolers for exhaust gas recirculation (EGR) applications, the currently available options for brazing material are both costly and difficult to work with. An exhaust gas to water jacket coolant EGR cooler can be expected to see inlet gas temperatures in excess of 1200° F. This temperature will quickly oxidize standard copper based brazing alloys used in heat exchanger construction thereby causing premature failure. The plates used in the heat exchanger itself have hot exhaust gas on one side, and coolant on the other, keeping the actual metal temperature under 300° F.

It is therefore desirable to use plates clad with braze alloy on one side only, exposing the braze alloy to the coolant, and the stainless steel base metal to the hot gas.

SUMMARY OF THE INVENTION

A high temperature prime surface heat exchanger is created by a plurality of plates having braze cladding on a first surface thereof that are formed to create a first plurality of fluid flow passages for coolant and a second plurality of fluid flow passages for hot gas when assembled into a core by stacking the plates. The first plurality of passages for the coolant are adjacent the first or clad surface of each formed plate to avoid direct contact with the high temperature gas flowing in the second plurality of passages. The adjacent plates pairs are joined by brazing of a contacting portion of the first surface on each plate to form sealed coolant passages the core.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1:
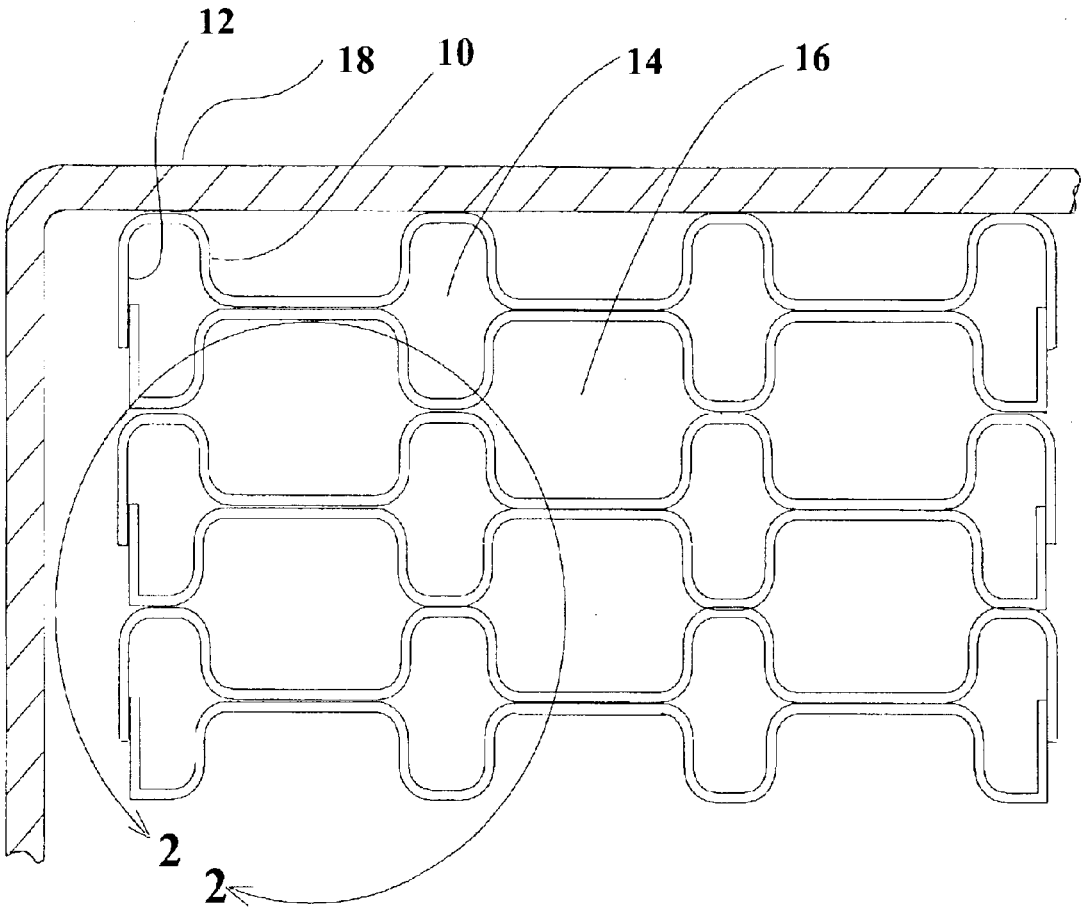
FIG. 1 is a partial section view of the prime surface plates in a heat exchanger employing the present invention with braze cladding on only one surface of each plate which is exposed to the coolant.

A series of prime surface plates 10 are formed as shown in FIG. 1 with cladding 12 of copper, or other braze alloy, on one side of the stainless steel plate elements. The plates are assembled together as a core to make gas and coolant passages, alternating on either side of the plates. The copper clad side lines the coolant passages 14, and the base metal side lines the gas passages 16. The second side of the plate remains unclad with any form of brazing alloy which might be attacked by the high temperature or corrosive nature of the gas in the gas passages. Those skilled in the art will recognize that certain corrosion inhibiting cladding or sacrificial coating may be employed on all or portions the second or base metal surface to further enhance the survivability of the plates in the high temperature gas environment. However, the second surface is substantially devoid of any braze cladding which would be adversely affected by the high temperature gas flowing in the gas passages. The forming of the plates provides fluid passages, increases the surface area of the plates, and provides turbulation to enhance the heat transfer between the two fluids. The core is carried in a case 18 with appropriate inlet and outlet manifolds for the coolant and gas.

For the embodiment shown, the intended heat exchanger employs liquid coolant for cooling a heated gas such as recirculated exhaust gas. The coolant passages formed in the core have a cross sectional area of about one-third the gas passage area.

Figure 2:
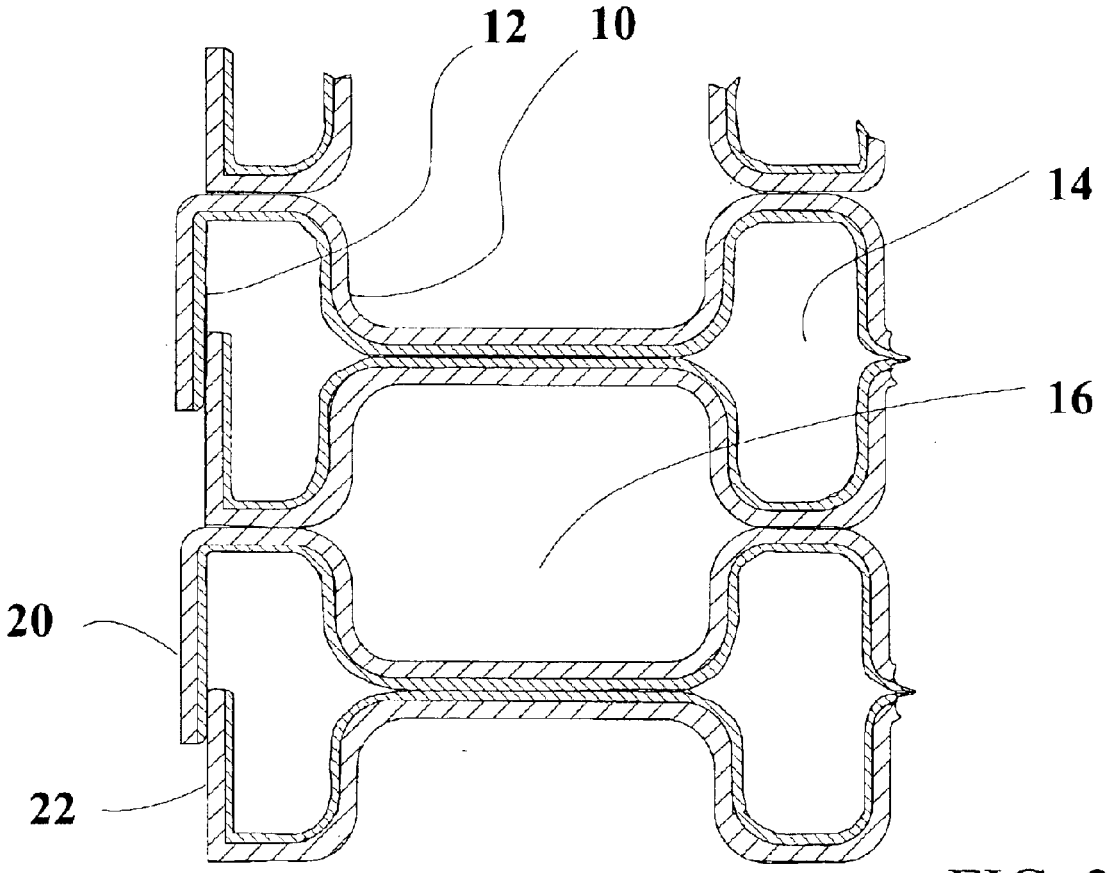
FIG. 2 is an expanded view of a portion of the core shown by line 2—2 of the embodiment of the heat exchanger in FIG. 1 showing the cladding.

Stamping or roll forming of the plates provides a consistent pattern for plate match-up in the core stack for brazing. As shown in FIG. 2, the braze cladding 12 meets on adjacent braze surfaces sealing the coolant passages. The cladding thickness in the drawing is exaggerated to show the relationship between the clad plates. Actual cladding thickness is between 0.001" and 0.003" with average plate thickness of about 0.015". Stainless steel plate is clad one side only with the brazing alloy then cut and formed using the previously disclosed stamping or rolling processes. Brazing alloys in various embodiments include copper and copper alloy.

The formed plates are stacked into the core assembly with clad surfaces adjacent one another and furnace brazed at about 2000 degrees F. The end corrugation on adjacent plates in the embodiment shown in FIGS. 1 and 2 is asymmetrically formed to place the unclad surface of an end tab 20 on a lower mating plate in close contact with the clad surface of an end tab 22 on the adjacent upper mating plate. An effective braze seal is created for the end coolant passages without exposing the clad surface of the plate to the exhaust gas passages.

Figure 3:
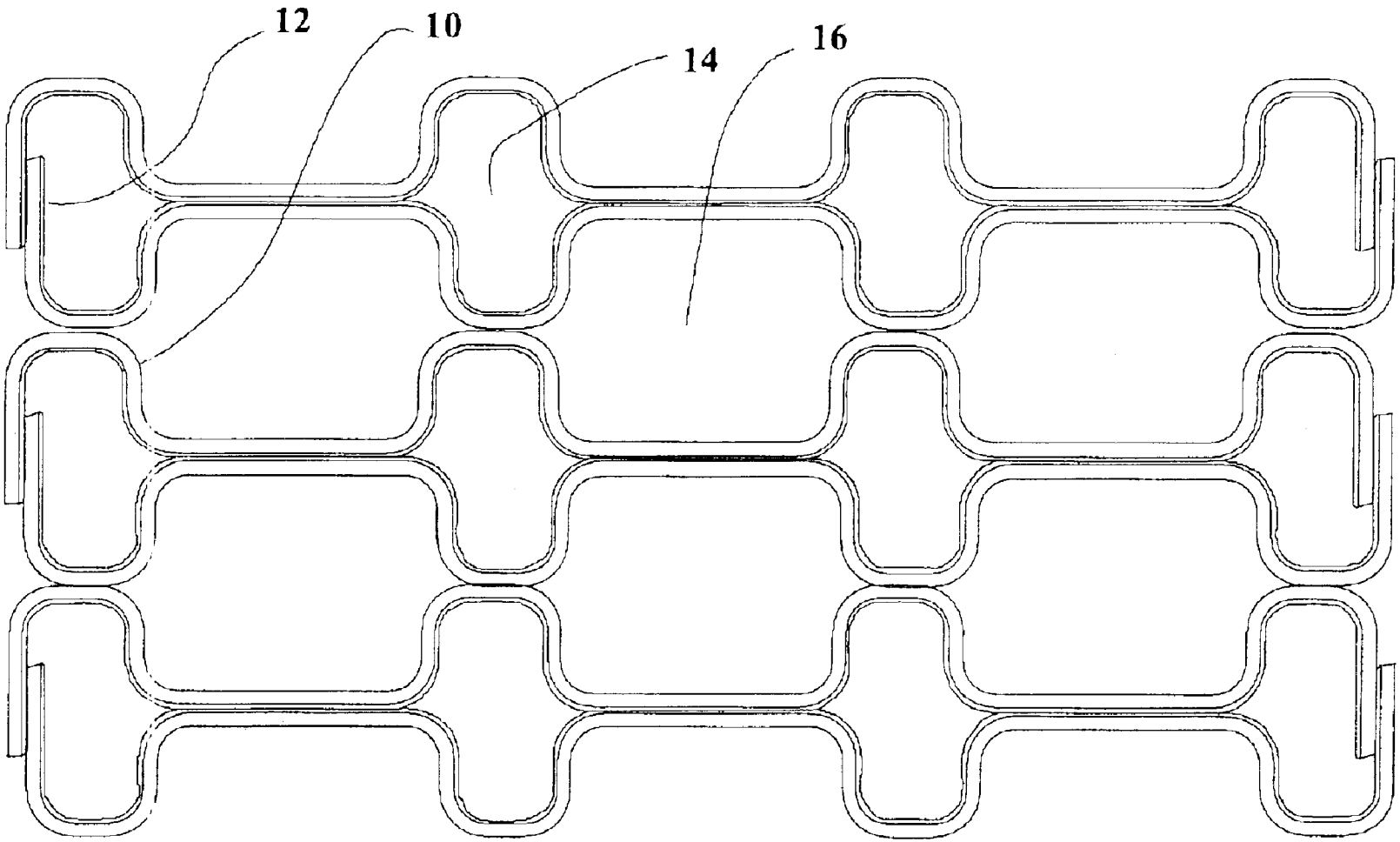
FIG. 3 is a view of a second symmetrical embodiment for the prime surface plates of a heat exchanger employing the invention.

FIG. 3 shows an alternative embodiment wherein the upper and lower plates of each adjacent pair in the core are symmetrically formed with the lower plate inverted and offset by one plate width during stacking to bring the clad and unclad surfaces of the end corrugations into contact. The end corrugations of adjacent plates can alternatively be resiliently deformed during stacking to create the end joints while maintaining alignment of the interior corrugations of the core. This mating of clad and unclad surfaces at the end corrugations makes use of the single clad first surface to provide braze material from the cladding to create the braze with the unclad second surface.

Alternating plate pairs are constrained mechanically by the core manifold tooling during brazing and by the case after insertion of the core. The brazed surfaces surround the coolant passages to create sealed conduits. The gas passages may have minor cross leakage and leakage into the case without significant performance degradation. The core assembly is then fitted with manifold plates or headers welded to the core plate edges with apertures aligned to introduce the coolant and hot gas. The core is inserted into the case supported by the headers.

In operation, the hot gas flowing in the gas passages does not contact any braze clad surface thereby avoiding degradation of those surfaces. The braze alloy clad surface is immersed in the coolant flow thereby maintaining adequate temperature differential to prevent oxidation or other degradation of the braze alloy cladding.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A high temperature prime surface heat exchanger comprising:

a plurality of plates having braze cladding on a first surface thereof and substantially devoid of braze cladding on a second surface thereof, the plates formed to create a first plurality of fluid flow passages for coolant and a second plurality of fluid flow passages for hot gas, the first plurality of passages adjacent the first surface of each formed plate and the second plurality of fluid flow passages adjacent the second surface of each formed plate, adjacent pairs of said plurality of plates joined at least in part by brazing of contacting interior portions of the first surfaces of the adjacent plates to create a plurality of the plurality of fluid flow passages for coolant, and the adjacent pairs of plates constrained mechanically by a case.

2. A high temperature prime surface heat exchanger as defined in claim 1 wherein the plurality of plates are stainless steel.

3. A high temperature prime surface heat exchanger as defined in claim 1 wherein the braze cladding is copper.

4. A high temperature prime surface heat exchanger as defined in claim 1 wherein the braze cladding is copper alloy.

5. A high temperature prime surface heat exchanger as defined in claim 1 wherein the first surface of an end corrugation on a first plate of each adjacent pair is placed in contact with the second surface of an end corrugation on a second plate of the adjacent pair to form an end seal.

6. A method for manufacturing a prime surface heat exchanger as defined in claim 5 wherein a step of assembling includes placing the first surface of an end corrugation on a first adjacent plate in contact with an unclad surface of an end corrugation on a second adjacent plate to form an end seal during brazing.

7. A high temperature prime surface heat exchanger comprising:

a plurality of plates having braze cladding on a first surface thereof and substantially devoid of braze cladding on a second surface thereof, the plates formed to create a first plurality of fluid flow passages for coolant and a second plurality of fluid flow passages for hot gas, the first plurality of passages adjacent the first surface of each formed plate and the second plurality of fluid flow passages adjacent the second surface of each formed plate, adjacent pairs of said plurality of plates joined by brazing of contacting portions of the first surfaces of the adjacent plates, and the adjacent pairs of plates constrained mechanically by a case and wherein the first surface of an end corrugation on a first plate of each adjacent pair is placed in contact with the second surface of an end corrugation on a second plate of the adjacent pair to form an end seal.

8. A method for manufacturing a prime surface heat exchanger comprising the steps of:

applying braze cladding to a first surface of a plate while retaining a second surface of the plate substantially devoid of braze cladding:

forming at least two plates into a plurality of heat exchanger prime surface elements;

assembling the prime surface elements into a heat exchanger core with contact between adjacent pairs of elements occurring on contacting portions of the first surface;

brazing the contacting portions of the plurality of elements to form fluid flow passages for coolant flow adjacent the first surface; and wherein the step of assembling includes placing the first surface of an end corrugation on a first adjacent plate in contact with an unclad surface of an end corrugation on a second adjacent plate to form an end seal during brazing.

* * * * *